US010816181B2

(12) United States Patent
De Mol et al.

(10) Patent No.: US 10,816,181 B2
(45) Date of Patent: Oct. 27, 2020

(54) LIGHT MODULE PROVIDING POSITIONING AND FIXATION OF A CIRCUIT BOARD IN A HOUSING

(71) Applicant: SIGNIFY HOLDING B.V., Eindhoven (NL)

(72) Inventors: Eugen Jacob De Mol, Eindhoven (NL); James Jin, Eindhoven (NL); Wessel Van Sluis, Overpelt (BE); Liang Tian, Shanghai (CN); Willem Van Dijk, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/492,939

(22) PCT Filed: Mar. 12, 2018

(86) PCT No.: PCT/EP2018/056051
§ 371 (c)(1),
(2) Date: Sep. 10, 2019

(87) PCT Pub. No.: WO2018/166962
PCT Pub. Date: Sep. 20, 2018

(65) Prior Publication Data

US 2020/0018467 A1 Jan. 16, 2020

(30) Foreign Application Priority Data

Mar. 1, 2017 (WO) ..... PCT/CN2017/076673
May 30, 2017 (EP) ..... 17173472

(51) Int. Cl.
*F21V 23/00* (2015.01)
*F21V 15/01* (2006.01)
(Continued)

(52) U.S. Cl.
CPC ..... *F21V 23/006* (2013.01); *F21V 15/01* (2013.01); *F21V 19/0035* (2013.01);
(Continued)

(58) Field of Classification Search
CPC .... F21V 23/006; F21V 15/01; F21V 19/0035; F21V 19/0055; F21V 29/508; F21V 29/503; F21V 29/70
See application file for complete search history.

(56) References Cited

U.S. PATENT DOCUMENTS

2012/0140442 A1 6/2012 Woo et al.
2014/0146548 A1 5/2014 De Anna et al.
(Continued)

FOREIGN PATENT DOCUMENTS

CN 203104937 U 7/2013
CN 103775861 A 5/2014
(Continued)

*Primary Examiner* — Joseph L Williams
(74) *Attorney, Agent, or Firm* — Daniel J. Piotrowski

(57) ABSTRACT

There is provided a light module having a housing, a first circuit board arranged in the housing and comprising a central through hole, a front side on which driver electronics through-hole components are mounted, and a back side from which leads of the driver electronics through-hole components protrude, wherein a gap behind the first circuit board accommodates the leads, and a second circuit board electrically connected to the first circuit board and comprising at least one solid-state lighting element adapted to emit light, wherein the second circuit board is arranged in level with the first circuit board or in a plane behind the first circuit board.

11 Claims, 5 Drawing Sheets

(51) Int. Cl.

| | |
|---|---|
| ***F21V 29/503*** | (2015.01) |
| ***F21V 29/508*** | (2015.01) |
| ***F21V 29/70*** | (2015.01) |
| ***F21V 19/00*** | (2006.01) |
| *F21Y 115/10* | (2016.01) |
| *F21S 8/02* | (2006.01) |

(52) U.S. Cl.
CPC ..... *F21V 19/0055* (2013.01); *F21V 29/503* (2015.01); *F21V 29/508* (2015.01); *F21V 29/70* (2015.01); *F21S 8/02* (2013.01); *F21Y 2115/10* (2016.08)

(56) References Cited

U.S. PATENT DOCUMENTS

| | | | |
|---|---|---|---|
| 2015/0085495 | A1 | 3/2015 | Seki |
| 2016/0091175 | A1 | 3/2016 | Kim et al. |
| 2016/0131350 | A1 | 5/2016 | Li et al. |
| 2016/0161099 | A1 | 6/2016 | Kim et al. |

FOREIGN PATENT DOCUMENTS

| | | | |
|---|---|---|---|
| CN | 203632965 | U | 6/2014 |
| CN | 104254732 | A | 12/2014 |
| CN | 104428583 | A | 3/2015 |
| CN | 205782051 | U | 12/2016 |
| DE | 102012215934 | A1 | 3/2014 |
| EP | 2674671 | A1 | 12/2013 |
| EP | 3101331 | A1 | 12/2016 |
| WO | 2014009181 | A1 | 1/2014 |

LIGHT MODULE PROVIDING POSITIONING AND FIXATION OF A CIRCUIT BOARD IN A HOUSING

CROSS-REFERENCE TO PRIOR APPLICATIONS

This application is the U.S. National Phase application under 35 U.S.C. § 371 of International Application No. PCT/EP2018/056051, filed on Mar. 12, 2018, which claims the benefit of Chinese Patent Application No. PCT/EP2018/056051, filed on Mar. 14, 2017 and European Patent Application No. 17173472.6, filed on May 30, 2017. These applications are hereby incorporated by reference herein.

FIELD OF THE INVENTION

The invention relates to light module, for example a down light module. The invention also relates to a method of assembling a light module.

BACKGROUND OF THE INVENTION

A down light (or downlight) module is generally a light module which may be integrated into existing or new fixtures or luminaires for downlighting applications in offices, hospitality, retail, general ambient illumination, etc.

For fixed output products, it is known to add the driver electronics to the LED PCB in the housing of the down light module. This solution has disadvantages, including: only SMD components can be used, the PCB area left for driver electronics is limited, and EMC issues.

Furthermore, US2012/0140442 discloses a light source for an illumination apparatus, which light source includes a light emitting device; a first printed circuit board on which the light emitting device is mounted; a power unit module supplying an electrical signal to the light emitting device, the power unit module comprising a second printed circuit board; a support unit having the light emitting device thereon and discharging heat generated by the light emitting device to the outside; and a housing unit covering and protecting the light emitting device, the power unit module and the support unit. The board on which the light emitting device is mounted is separated and spaced apart from the circuit board of the power unit module to be disposed above the circuit board of the power unit module.

In US 2015/085495 a lamp is disclosed comprising a LED board, a circuit board mounted on a reflector, said LED board positioned at an axial distance from the circuit board and in thermal contact with a heat conducting sheet at the outside of the housing.

SUMMARY OF THE INVENTION

It is an object of the present invention to provide an improved light module, which in particular can fulfill height limitations, has a reduced cost, and/or can be assembled fast with accurate positioning and fixation of the circuit board(s) in the housing.

According to a first aspect of the invention, this and other objects are achieved by a light module, comprising: a housing; a first circuit board arranged in the housing and comprising a central through hole, a front side on which driver electronics through-hole components are mounted, and a back side from which leads of the driver electronics through-hole components protrude, wherein a gap behind the first circuit board accommodates the leads; and a second circuit board electrically connected to the first circuit board and comprising at least one solid-state lighting element adapted to emit light, wherein the second circuit board is arranged in level with the first circuit board or in a plane behind the first circuit board.

By arranging the second circuit board comprising the solid-state lighting element(s) in level with or behind the first circuit board, in relation to a main light emitting direction of the light module, the light module may fulfill strict height limitations. Furthermore, the through-hole components may reduce the overall cost compared to if only SMD (surface-mount device) components are used.

The outer perimeter of the second circuit board may substantially match the circumference of the central through hole of the first circuit board. In this way, the second circuit board does not have to interfere with the leads of the driver electronics through-hole components. In case the second circuit board is arranged in level with the first circuit board, the second circuit board may be situated in the central through hole of the first circuit board.

The light module may further comprise a heat spreader arranged behind the first and second circuit boards. This heat spreader is preferably plate-shaped, and may further be adapted to close the rear of the housing. A plate-shaped heat spreader that closes the rear of the housing allows the light module to have a flat rear thermal interface.

The light module may further comprise an electrical insulator arranged between the first circuit board and the heat spreader. The electrical insulator may for example be attached to the heat spreader. Furthermore, the electrical insulator may comprise a central through hole matching the central through hole of the first circuit board. In this way, the electrical insulator may prevent the leads of the driver electronics through-hole components to electrically connect to the heat spreader even if the first circuit board is situated relatively close to the heat spreader, while at the same time allowing the second circuit board comprising the solid-state lighting element(s) to be in physical contact with the heat spreader, to minimize the thermal resistance.

The heat spreader may be attached to the housing by means of screws. The heat spreader may at the screws comprise portions that protrude towards the first circuit board. These portions may accurately ensure the aforementioned gap, as they rest against the first circuit board. The gap may for example be less than 3 mm. Furthermore, the heat spreader may at each of the portions that protrude towards the first circuit board comprise a recess adapted to accommodate the head of one of the screws. This allows the rear thermal interface of the light module to be really flat, for customer design heat sink.

According to a second aspect of the invention, there is provided a method of assembling a light module, which method comprises: providing a housing; placing a first circuit board in the housing, the first circuit board comprising a central through hole, a front side on which driver electronics through-hole components are mounted, and a back side from which leads of the driver electronics through-hole components protrude; and placing a second circuit board, the second circuit board comprising at least one solid-state lighting element adapted to emit light, wherein the second circuit board is arranged in level with the first circuit board or in a plane behind the first circuit board. The method may further comprise: closing the rear of the housing by means of a heat spreader; and attaching the heat spreader to the housing by means of screws. This aspect may exhibit the same or similar features and technical effects as the first aspect, and vice versa.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions may be exaggerated for illustrative purposes and, thus, may be provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
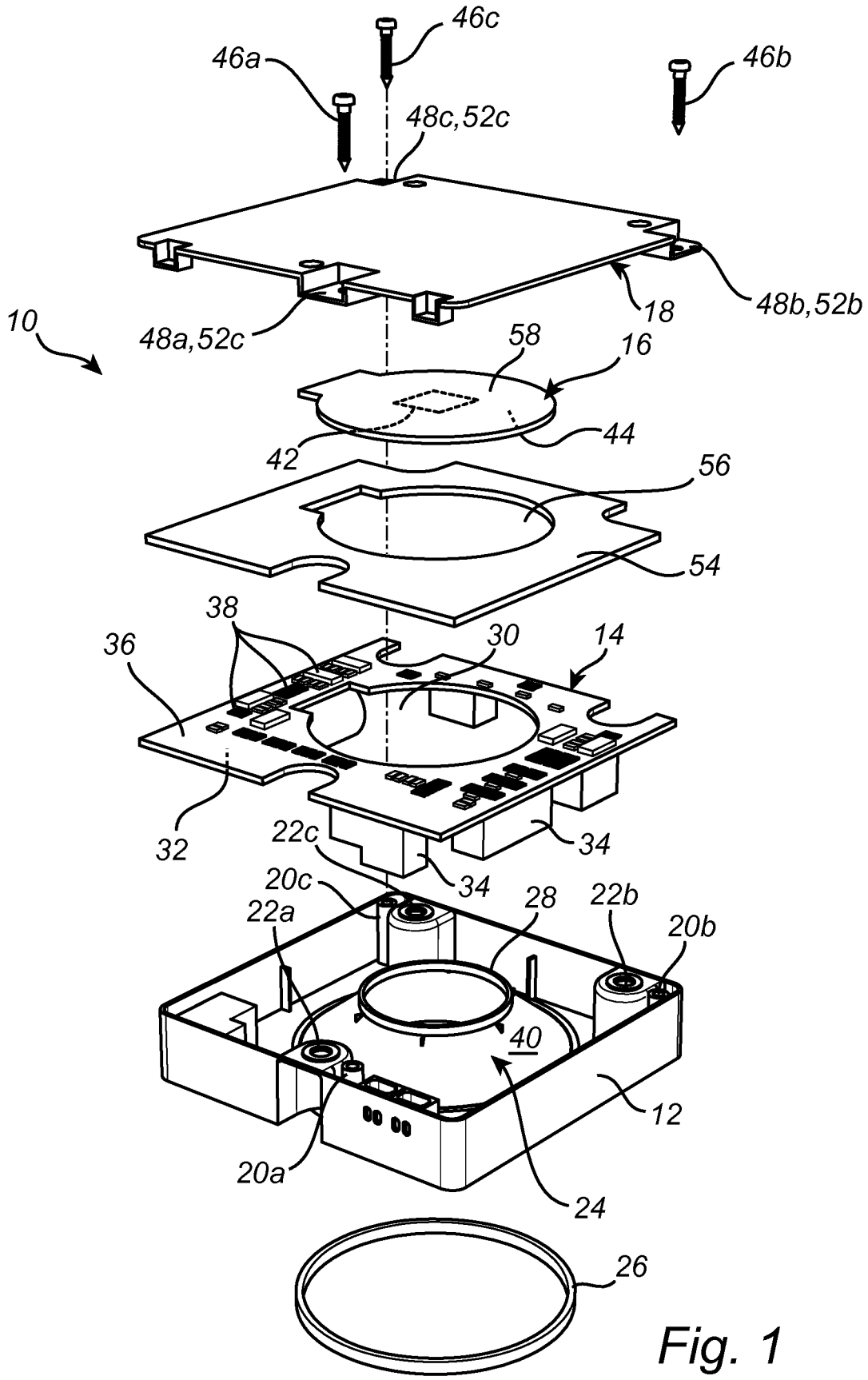
FIG. 1 is an exploded perspective view of a down light module according to an embodiment of the invention.
Figure 2:
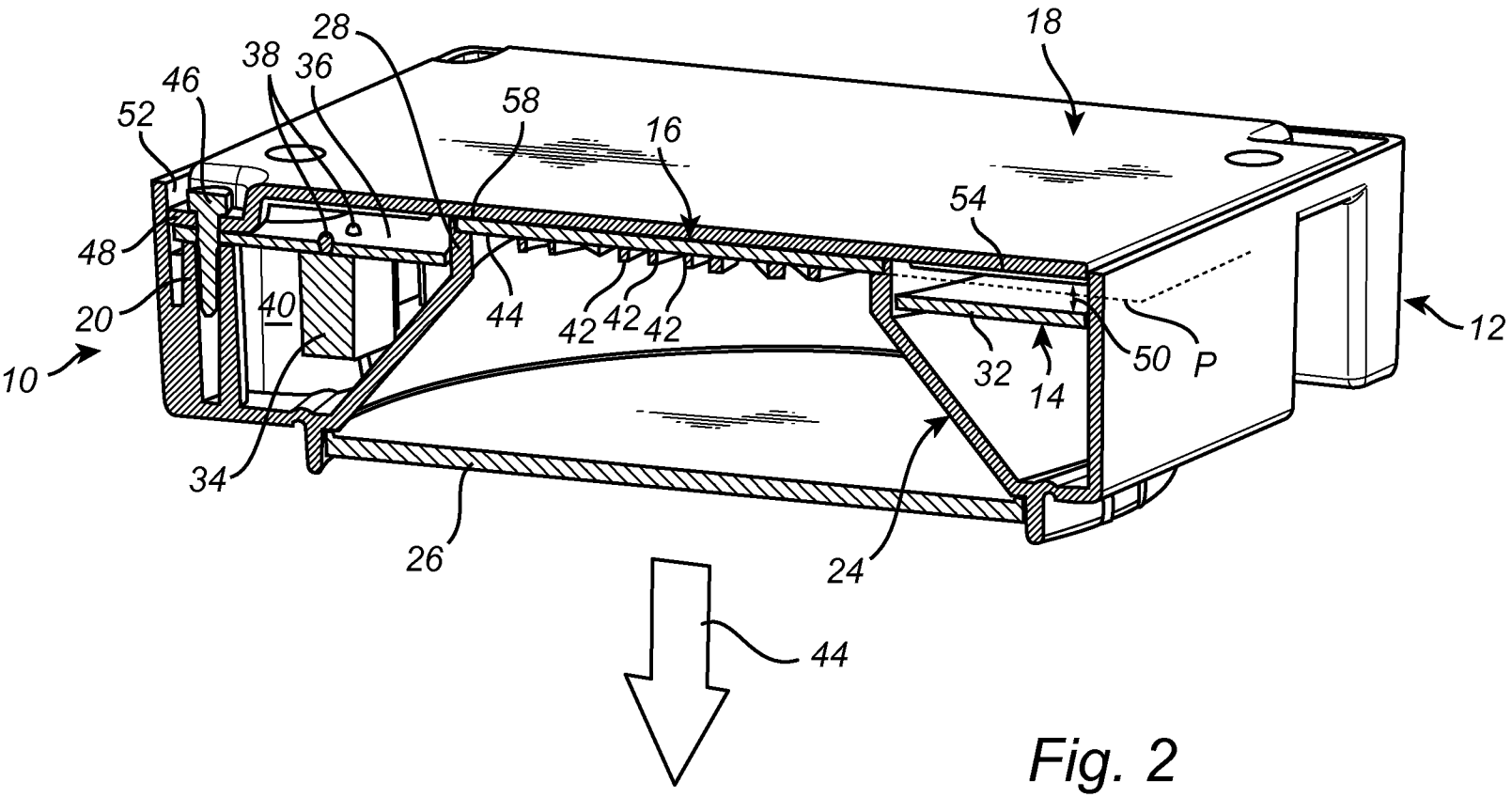
FIG. 2 is a cross-sectional perspective view of the down light module of FIG. 1.

FIG. 1-2 show a light module, namely a down light module 10, according to an embodiment of the invention. The down light module 10 of FIGS. 1-2 comprises a housing 12, a first circuit board 14, a second circuit board 16, and a separate heat spreader 18.

The housing 12 may have a size of 81.5 mm (L)×81.5 mm (W)×18.5 mm (H). The housing 12 may be a plastic housing 12. The housing 12 can for example be made of poly carbonate (PC). The housing 12 comprises screw bosses 20*a-c*, through-holes 22*a-c* for mounting of the down light module 10 to a fixture or luminaire (not shown), and a reflector 24. At a wider end of the reflector 20, an optical element 26 is arranged. The optical element 26 may for example be a lens or a diffuser. At the narrower end of the reflector 24, the housing 12 comprises a central, circular holder 28 for the second circuit board 16.

The first circuit board 14 is arranged in the housing 12 and supported by the screw bosses 20*a-c*. The first circuit board 14 is preferably a printed circuit board (PCB). The first circuit board 14 may for example be an FR4 PCB. The first circuit board 14 comprises a central through hole 30. The central through hole 30 is here circular, and has a slightly larger diameter than the central, circular holder 28, wherein the first circuit board 14 is arranged so that it surrounds the central, circular holder 28. The first circuit board 14 has a front side 32 on which driver electronics through-hole components 34 are mounted, and a back side 36 from which leads 38 of the driver electronics through-hole components 34 may protrude. The driver electronics through-hole components 34 may be disposed around the central through hole 30. The driver electronics through-hole components 34 may be accommodated in a space 40 behind the reflector 24 of the housing 12.

The second circuit board 16 is arranged in the housing 12 and supported by the central, circular holder 28. The second circuit board 16 is preferably a printed circuit board. The second circuit board 16 may for example be an example be an MCPCB (metal core circuit board). The second circuit board 16 comprises at least one solid-state lighting element 42 adapted to emit light. Here, the at least one solid-state lighting element 42 is a plurality of light emitting diodes (LEDs) surface-mounted on the second circuit board 16, namely on a front side 44 of the second circuit board 16. The second circuit board 16 is electrically connected to the first circuit board 14, for example via soldered wires or connectors (not shown), whereby the driver electronics through-hole components 34 are adapted to power the at least one solid-state lighting element 42. The second circuit board 16 is arranged in a plane P behind the first circuit board 14, in relation to a main light emitting direction 44 of the down light module 10. The plane P is parallel to the first circuit board 14. Furthermore, the outer perimeter of the second circuit board 16 substantially matches the circumference of the central through hole 30 of the first circuit board 14, whereby the second circuit board 16 does not interfere with the leads 38 of the driver electronics through-hole components 34, as the second circuit board 16 is (laterally) aligned with the central through hole 30.

The heat spreader 18 is arranged behind the first and second circuit boards 14, 16. The heat spreader 18 can be made of metal, such as aluminum. The heat spreader 18 can be made from sheet metal. The heat spreader 18 is plate-shaped, i.e. relatively flat and thin. The thickness of the heat spreader 18 may for example be 1.5 mm. Furthermore, the heat spreader 18 is adapted to close the rear of the housing 12 of the down light module 10, as shown in FIGS. 1-2.

The heat spreader 18 is mechanically attached to the housing 12 by means of three screws 46*a-c* mating with corresponding holes of the screw bosses 20*a-c*. The screws 46*a-c* may be self-tapping. At the screws 46*a-c*, the heat spreader 18 comprises portions 48*a-c* that protrude towards and rest against the back side 36 of the first circuit board 14; one such portion 48*a-c* per screw 46*a-c*. By means of the (protruding) portions 48*a-c*, a gap 50 is formed behind the first board 14. The gap 50 may accommodate the leads 38 and/or associated solder joints. The gap 50 may for example be less than 3 mm. Furthermore, as the heat spreader 18 is mechanically attached to the housing 12 by means of the screws 46*a-c*, both the first and second circuit boards 14, 16 are sandwiched between the housing 12 and the heat spreader 18; the first circuit board 14 is sandwiched between the screw bosses 20*a-c* and (protruding) portions 48*a-c* of the heat spreader 16, whereas the second circuit board 16 is sandwiched between the central, circular holder 26 and a central area of the heat spreader 16. At each of the (protruding) portions 48*a-c*, the heat spreader 18 comprises a recess 52*a-c* adapted to accommodate the head of one of the screws 46*a-c*. Each portion-recess combination 48/52 may be formed as a bend in the heat spreader 18. The recesses 52*a-c* allow the rear thermal interface of the down light module 10 to be really flat, as seen in particular FIG. 2.

In the embodiment of FIGS. 1-2, the two boards (first and second circuit boards 14, 16) can be fixed by the heat spreader 18 individually and can accommodate bigger piece part tolerance and board flatness.

The down light module 10 further comprises an electrical insulator 54 disposed between the first circuit board 14 and the heat spreader 18. Namely, the electrical insulator 54 is attached to the heat spreader 18, for example by means of a thermally conducting glue (not shown). The electrical insulator 54 may for example be an insulation film. The electrical insulator 54 may comprise a central through hole 56 matching the central through hole 30 of the first circuit board 14. In this way, the electrical insulator 54 may prevent the leads 38 of the driver electronics through-hole components 34 to electrically connect to the heat spreader 18, while at the same time allowing the back side 58 of the second circuit board 16 to be in physical contact with the heat spreader 18, for example via the aforementioned thermally conducting glue.

In operation, the driver electronics through-hole components 34 drives the at least one solid-state lighting element 42 so that the latter emits light. The emitted light may be reflected by the reflector 24 before exiting the light emitting module 10 through the optical element 26. Heat generated by the at least one solid-state lighting element 42 may be moved by the heat spreader 18, for example to an external heat sink (not shown).

Figure 3:
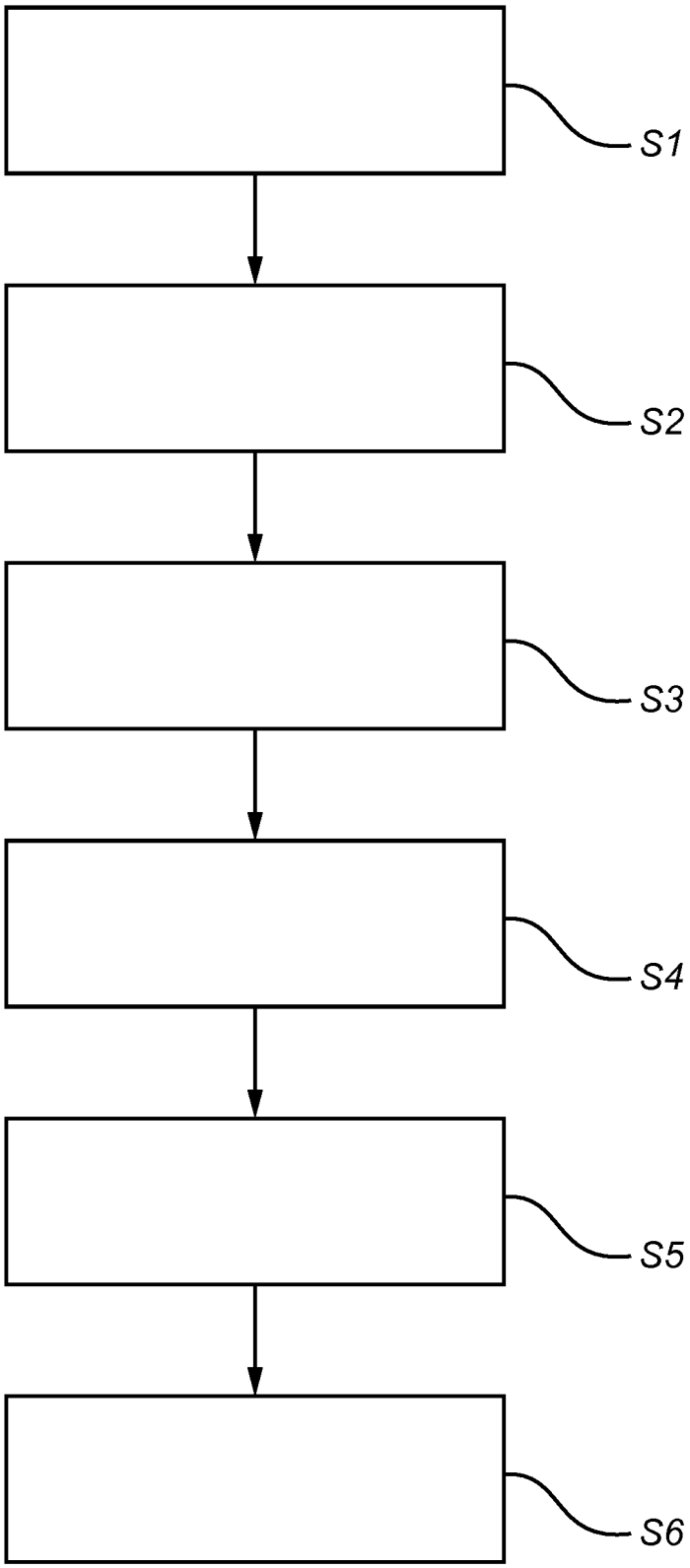
FIG. 3 is a flow chart of a method of assembling the down light module of FIGS. 1 and 2.

The flow chart of FIG. 3 illustrates a method of assembling the down light module 10. The method may be manual, partly automated, or fully automated. First, the housing 12 is provided (step S1). Then the first circuit board 14 is placed in the housing 12 (step S2), namely on the screw bosses 20*a-c*. In step S3, the second circuit board 16 is placed in the housing 12, namely on the central holder 28. Then the first and second first circuit board 14 may be electrically connected to each other (step S4), for example via two wires. In step S5, the rear of the housing 12 is closed by means of the heat spreader 18, wherein the (protruding) portions 48*a-c* rest against the first circuit board 14. The electrical insulator 54 is preferably attached to the heat spreader 18 before this step. Finally, in step S6, the heat spreader is attached to the housing 12 by means of the screws 46*a-c*.

Figure 4:
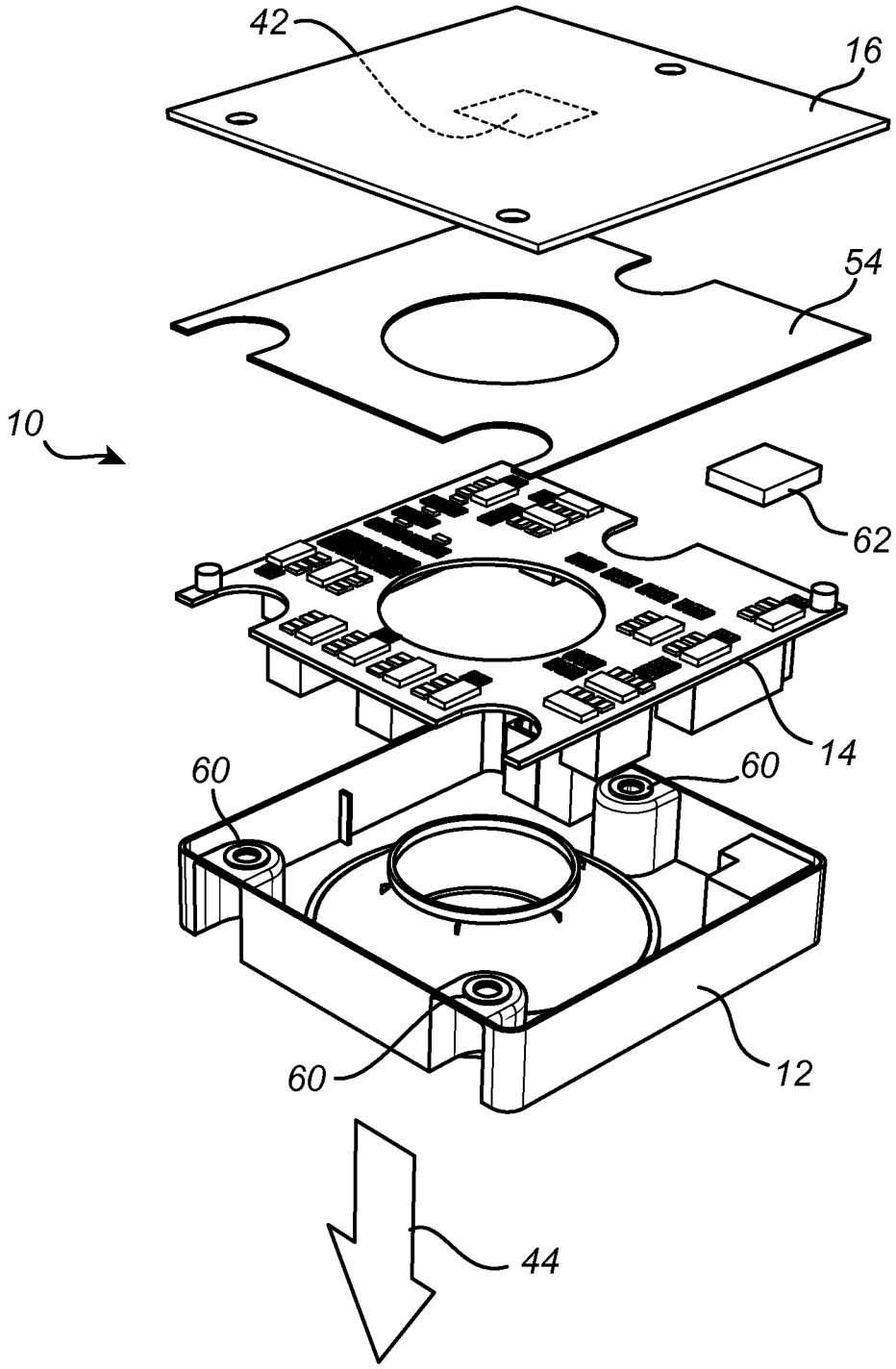
FIG. 4 is an exploded perspective view of another embodiment of the down light module.

FIG. 4 is an exploded perspective view of another embodiment of the down light module 10. In this embodiment, the second circuit board 16 closes the rear of the housing 12, and there is no separate heat spreader 18. Instead, the second circuit board 16 acts as heat spreader. The second circuit board 16 may here be an insulated metal substrate (IMS) circuit board or a metal core circuit board (MCPCB). The second circuit board 16 may here have an outer perimeter (substantially) matching the outer perimeter of the first circuit board 14. The at least one solid-state lighting element 42 is surface mounted on a central portion of the second circuit board 16, which central portion is aligned with the central through hole 30 of the first circuit board 14. The second circuit board 16 is here arranged (in a plane) behind the first circuit board 14, relative to the main light emitting direction 44 of the down light module 10. The first circuit board 14 is here heat-staked to the housing 12, whereas the second circuit board 16 is fixed to the housing 12 by means of double-sided tape (rings 60). The down light module 10 of this embodiment may be assembled in the following way: 1) Placing the first circuit board 14 in the housing 12. 2) Fixing the first circuit board 14 to the housing 12 by means of heat staking. 3) Placing a thermal pad 62 on the back side of the first circuit board 4. 4) Placing the electrical insulator 54, for example an isolator sheet, on the back side of the first circuit board 14. 5) Placing (double-sided) adhesive rings 60 on the housing 12. 6) Fixing the second circuit board 16 to the housing 12 by means of the adhesive rings 60.

Figure 5:
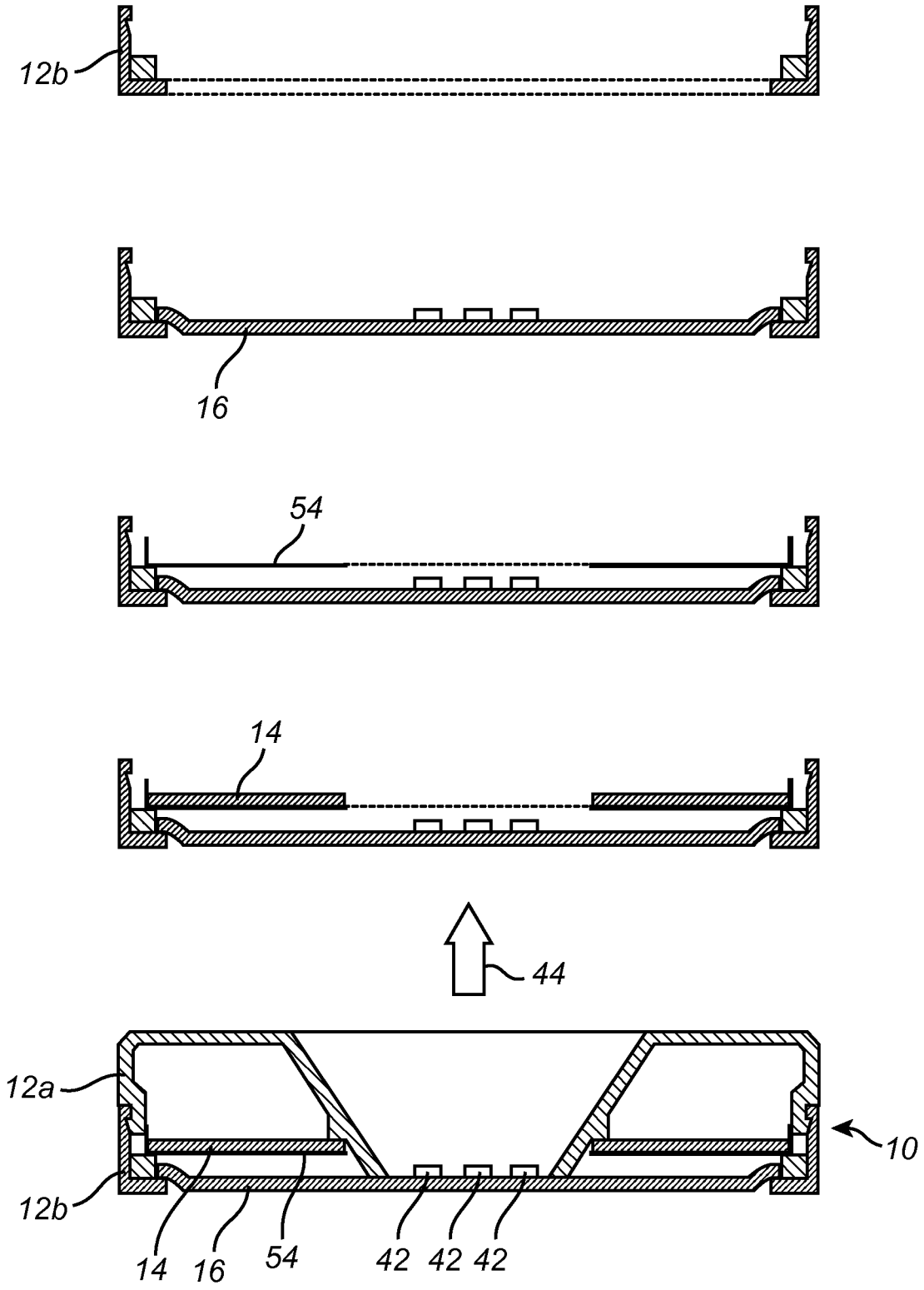
FIG. 5 is a side view illustrating assembly of the down light module according to yet another embodiment.

FIG. 5 is a side view illustrating assembly of the down light module 10 according to yet another embodiment. In this embodiment, the second circuit board 16 closes the rear of the housing 12, and there is no separate heat spreader 18. Instead, the second circuit board 16 acts as heat spreader. The second circuit board 16 may here be an insulated metal substrate (IMS) circuit board or a metal core circuit board (MCPCB). The second circuit board 16 may here have an outer perimeter (substantially) matching the outer perimeter of the first circuit board 14. The at least one solid-state lighting element 42 is surface mounted on a central portion of the second circuit board 16, which central portion is aligned with the central through hole 30 of the first circuit board 14. The second circuit board 16 is here arranged (in a plane) behind the first circuit board 14, relative to the main light emitting direction 44 of the down light module 10. The housing 12 here comprises an upper part 12*a* and a lower part 12*b*, and the housing 12 is designed so that the first and second circuit boards 14, 16 are (both) sandwiched between the upper and lower parts 12*a-b* of the housing 12. The upper and lower parts 12*a-b* of the housing 12 may be mechanically connected to each other by snap-fitting means. The down light module 10 of this embodiment may be assembled in the following way: 1) Providing the lower part 12*b* of the housing 12. 2) Placing the second circuit board 16 (on a lower edge) in the lower part 12*b* of the housing 12. 3) Placing the electrical insulator 54, for example an isolation foil, (on an upper edge) in the lower part 12*b* of the housing 12. 4) Placing the first circuit board 14, over the electrical insulator 54. 5) Placing the upper part 12*a* of the housing 12, whereby the first and second circuit boards 14, 16 are sandwiched between the upper and lower parts 12*a-b* of the housing 12.

The person skilled in the art realizes that the present invention by no means is limited to the preferred embodiments described above. On the contrary, many modifications and variations are possible within the scope of the appended claims. For example, the present light module could be used in other applications than downlighting. Furthermore, the down light module 10 may have either fixed output or be dimmable. Furthermore, the down light module 10 could comprise means for (wireless) communication with an external device.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light module, comprising:

a housing;

a first circuit board arranged in the housing and comprising a central through hole, a front side on which driver electronics through-hole components are mounted, and a back side from which leads of the driver electronics through-hole components protrude, wherein a gap behind the first circuit board accommodates said leads;

a second circuit board electrically connected to the first circuit board and comprising at least one solid-state lighting element adapted to emit light, wherein the second circuit board is arranged in level with the first circuit board or in a plane behind the first circuit board; and, a heat spreader arranged behind the first and second circuit boards, an electrical insulator arranged between the first circuit board and the heat spreader, wherein the electrical insulator comprises a central through hole matching the central through hole of the first circuit board, and said electrical insulator is attached to the heat spreader.

2. The light module according to claim 1, wherein the outer perimeter of the second circuit board substantially matches the circumference of the central through hole of the first circuit board.

3. The light module according to claim 1, wherein the heat spreader is plate-shaped.

4. The light module according to claim 1, wherein the heat spreader closes the rear of the housing.

5. The light module according to claim 1, wherein the second circuit board is in physical contact with the heat spreader.

6. The light module according to claim 1, wherein the heat spreader is attached to the housing by means of screws (46*a-c*).

7. The light module according to claim 6, wherein the heat spreader at said screws comprises portions (48*a-c*) that protrude towards the first circuit board.

8. The light module according to claim 7, wherein the heat spreader at each of said portions that protrude towards the first circuit board comprises a recess (52*a-c*) adapted to accommodate the head of one of said screws.

9. The light module according to claim 1, wherein said gap is less than 3 mm.

10. A method of assembling a light module, which method comprises:

providing a housing;

placing a first circuit board in the housing, the first circuit board comprising a central through hole, a front side on which driver electronics through-hole components are mounted, and a back side from which leads of the driver electronics through-hole components protrude;

placing a second circuit board, the second circuit board comprising at least one solid-state lighting element adapted to emit light, wherein the second circuit board is arranged in level with the first circuit board or in a plane behind the first circuit board;

placing a heat spreader arranged behind the first and second circuit boards and an electrical insulator arranged between the first circuit board and the heat spreader, wherein the electrical insulator comprises a central through hole matching the central through hole of the first circuit board.

11. A method according to claim 10, further comprising:

closing the rear of the housing by means of the heat spreader; and attaching the heat spreader to the housing by means of screws (46*a-c*).

* * * * *